US008235239B2

(12) United States Patent
Kountotsis

(10) Patent No.: US 8,235,239 B2
(45) Date of Patent: Aug. 7, 2012

(54) DUAL CHAMBER BOTTLE AND METHOD OF MANUFACTURING THE SAME

(76) Inventor: Theodosios Kountotsis, East Elmhurst, NY (US)

( * ) Notice: Subject to any disclaimer, the term of this patent is extended or adjusted under 35 U.S.C. 154(b) by 536 days.

(21) Appl. No.: 12/291,617

(22) Filed: Nov. 12, 2008

(65) Prior Publication Data

US 2010/0116769 A1 May 13, 2010

(51) Int. Cl.
*B65D 1/24* (2006.01)

(52) U.S. Cl. ..... 220/555; 220/23.8; 220/23.83

(58) Field of Classification Search ..... 215/306, 215/6, 592, 322; 220/556, 555, 553, 500, 220/375, 249, 754, 710.5; 222/129
See application file for complete search history.

(56) References Cited

U.S. PATENT DOCUMENTS

| | | | | |
|---|---|---|---|---|
| 1,836,811 | A * | 12/1931 | McNeal | 220/291 |
| 4,971,211 | A | 11/1990 | Lake | |
| 5,332,157 | A | 7/1994 | Proctor | |
| D361,509 | S | 8/1995 | Dull et al. | |
| 5,497,920 | A | 3/1996 | Moeller et al. | |
| 5,507,156 | A | 4/1996 | Redmon | |
| 5,597,087 | A | 1/1997 | Vinarsky | |
| 5,667,101 | A | 9/1997 | Barrash et al. | |
| 6,010,034 | A | 1/2000 | Walthers | |
| 6,120,202 | A | 9/2000 | Donsky | |
| 6,135,323 | A | 10/2000 | Chen et al. | |
| 6,550,647 | B1 | 4/2003 | Kunz | |
| 6,601,283 | B2 * | 8/2003 | Wunderlich | 29/453 |
| 6,758,411 | B2 | 7/2004 | Conway et al. | |
| D497,104 | S | 10/2004 | Best et al. | |
| D507,738 | S | 7/2005 | Wagner | |
| D510,529 | S | 10/2005 | Yates, III | |
| 7,036,684 | B1 | 5/2006 | Hantman et al. | |
| 7,331,478 | B2 | 2/2008 | Aljadi | |
| 2004/0159625 | A1 | 8/2004 | Kwon | |
| 2005/0109796 | A1 | 5/2005 | Bourque et al. | |
| 2005/0184090 | A1 | 8/2005 | DeJonge | |
| 2006/0021996 | A1 | 2/2006 | Scott, III et al. | |
| 2006/0102581 | A1 | 5/2006 | Yates, III | |
| 2008/0000866 | A1 | 1/2008 | Yates, III | |
| 2008/0121654 | A1 | 5/2008 | Pikowski | |
| 2008/0128378 | A1 | 6/2008 | Nowzari | |

* cited by examiner

*Primary Examiner* — Anthony Stashick
*Assistant Examiner* — Kevin Castillo
(74) *Attorney, Agent, or Firm* — Theodosios Kountotsis

(57) ABSTRACT

A bottle including a body portion having a dividing wall extending from a base portion to a connection region; a first chamber for holding a first liquid, the first chamber configured to connect to a first orifice; and a second chamber for holding a second liquid, the second chamber configured to connect to a second orifice; wherein a height of the dividing wall is less than an overall height of the body portion and the connection region is configured to be a maximum height of the dividing wall.

20 Claims, 13 Drawing Sheets

DUAL CHAMBER BOTTLE AND METHOD OF MANUFACTURING THE SAME

BACKGROUND

1. Field of the Related Art

The present disclosure relates to bottles, and more particularly, but not exclusively, to a bottle having dual chambers for separately dispensing liquids.

2. Description of the Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to the neck portion. These plastic drinking bottles are reasonably durable, are reusable with most liquid drinks of choice, are economical to make and to purchase, and are easy to use (in that an individual can grip the bottle with one hand and take a drink via the outlet means without spilling the liquid).

In particular, sports bottles have become very popular over the years as molded plastic drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and can be readily carried or placed without fear of spilling the liquid contained therein. To use a sports bottle, one simply places the desired liquid in the sport bottle and closes the lid and/or inserts a straw. Thereafter, whenever it is desired to acquire liquid, one merely opens the lid to allow access to the liquid.

Many individuals who exercise are interested in workouts of extended durations, at various levels of intensity. Thus, many individuals have available or even carry several individual bottles of water or other liquids to replenish body liquids lost from sweating. These individuals may particularly seek to take more than one type of drink while maintaining the same exercise pace and without carrying multiple bottles containing different liquids. Thus, many individuals may desire more than one type of drink to replenish body liquids lost from sweating when engaging in one or more intense workout activities, without inadvertently mixing the liquids.

Furthermore, one of the most critical needs facing individuals engaged in sports is the continuous supply or intake of different liquids (e.g., drinking water, sports drinks, energy drinks, protein shakes, etc.) while they exercise. During extended exercise activities, individuals face serious dehydration problems and the loss of competitive capability unless they continuously replenish the fluids lost during such exercise activities. However, the human body requires many different types of vitamins or minerals that cannot all be found in one type of liquid. As a result, once again, individuals may desire more than one type of drink to replenish body liquids lost from sweating when engaging in one or more intense workout activities, without inadvertently mixing the liquids, in order to replenish several types of vitamins and minerals.

Moreover, sports enthusiasts are typically becoming more aware of the benefits of combining the use of electrolyte replacing sports drinks and/or water and/or protein shakes for ultimate performance enhancement and refreshment. Additionally, even children/teenagers often desire to consume more than a single flavor of soft drink or juices or any other type of desirable liquid. Also, adults who consume caffeinated energy drinks frequently purchase bottled water to compliment the energy drink in order to quench their thirst. In other words, such individuals must carry two or more bottles to quench their thirst. Thus, there is a need to provide a bottle that is capable of dispensing more than one type of liquid separately, without inadvertently mixing the liquids.

Consequently, traditional sports bottles present a limitation in that they do not allow an individual to enjoy a plurality of different liquid drinks separately from each other, without mixing the liquids, and at the same time period. Presently, many dual chamber bottle systems lack the ability to effectively provide two or more liquids to an individual without mixing the liquid contents. In addition, another limitation is the fact that an individual must carry a plurality of bottles, each of the plurality of bottles containing different liquids. In addition, many individuals have a desire to combine the intake of liquids with the intake of solid supplements, such as energy bars, energy gels, vitamin supplements, etc.

Traditional dual chamber bottles do not provide for effective means of purposely separating two or more liquids or a liquid and a non-liquid desired to be consumed by an individual. In other words, traditional dual chamber bottles allow for inadvertent mixing of liquids, even though the individual desires to consume only one drink at a time. Thus, despite other practitioners' efforts to provide improved systems, there remains nonetheless a continuing need in the art for an improved liquid supply apparatus for use by individuals, such as, but not limited to, individuals engaged in sports or exercise activities.

The present disclosure is intended to overcome the drawbacks of conventional dual chamber bottle systems by exploiting bottle morphology in order to successfully separate liquids without allowing inadvertent mixing of liquids. It is desirable to provide a single container having multiple elements for storage of different commodities and a means for selecting between them during consumption. It is further desirable that such a container be easily manufactured, filled, and assembled. In particular, the present disclosure relates to a bottle for separately providing two or more liquids to an individual, without mixing the liquids. The present disclosure further relates to a method of manufacturing a dual chamber bottle that prevents the inadvertent mixture of liquids.

SUMMARY

The present disclosure provides a bottle including a body portion having a dividing wall extending from a base portion to a connection region; a first chamber for holding a first liquid, the first chamber configured to connect to a first orifice; and a second chamber for holding a second liquid, the second chamber configured to connect to a second orifice; wherein a height of the dividing wall is less than an overall height of the body portion and the connection region is configured to be a maximum height of the dividing wall.

The present disclosure also provides a bottle including a body portion having a dividing wall extending from a base portion to a connection region; a first chamber for holding a first liquid; a second chamber for holding a second liquid; and a removable cap having an orifice; wherein a height of the dividing wall is less than an overall height of the body portion and the connection region is configured to be a maximum height of the dividing wall.

The present disclosure also provides a bottle including a body portion having a dividing wall extending from a base portion to a connection region; a first chamber for holding a liquid, the first chamber configured to connect to an orifice; and a second chamber for storing one or more non-liquid elements, the second chamber configured to connect to an opening; wherein a height of the dividing wall is less than an overall height of the body portion and the connection region is configured to be a maximum height of the dividing wall.

The present disclosure also provides a method for manufacturing a bottle, the method including the steps of forming a body portion having a dividing wall extending from a base portion to a connection region; forming a first chamber for holding a first liquid, the first chamber configured to connect to a first orifice; and forming a second chamber for holding a second liquid, the second chamber configured to connect to a second orifice; wherein a height of the dividing wall is less than an overall height of the body portion and the connection region is configured to be a maximum height of the dividing wall.

The present disclosure also provides a method for manufacturing a bottle the method including the steps of forming a body portion having a dividing wall extending from a base portion to a connection region; forming a first chamber for holding a first liquid; forming a second chamber for holding a second liquid; and forming a cap having an orifice; wherein a height of the dividing wall is less than an overall height of the body portion and the connection region is configured to be a maximum height of the dividing wall.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the invention will become apparent to those skilled in the art from this detailed description.

BRIEF DESCRIPTION OF THE DRAWINGS

Various embodiments of the present disclosure will be described herein below with reference to the figures wherein.

DETAILED DESCRIPTION

Figure 1:
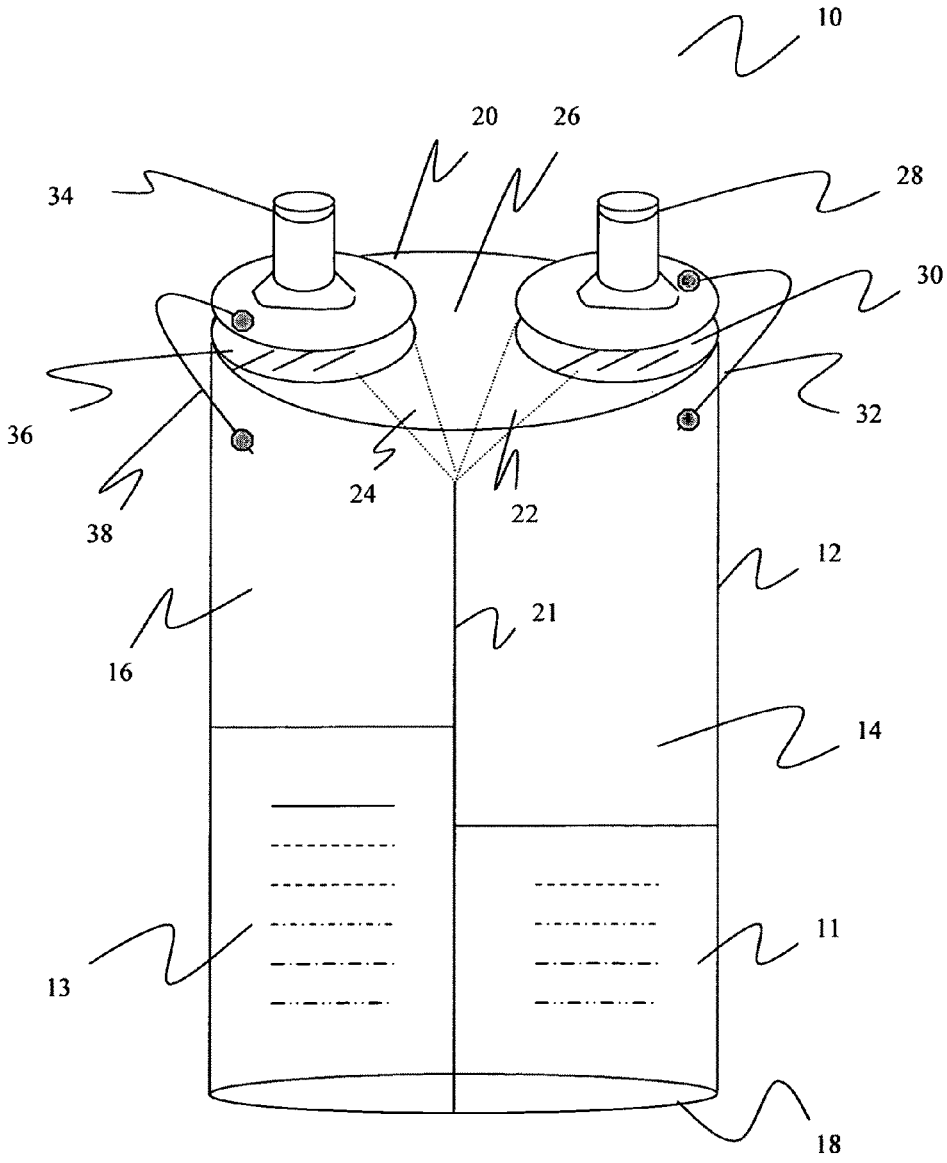
FIG. 1 is a perspective view of a dual-chambered drinking bottle having two volumetrically equal-sized chambers, in accordance with the present disclosure.

Unless otherwise indicated, all numbers expressing quantities and conditions, and so forth used in the specification and claims are to be understood as being modified in all instances by the term "about." In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connect to directly or indirectly or to be incorporated within.

As used in this description and in the appended claims, the word "container" does not necessarily refer to a rigid or a somewhat deformable structure, such as a "bottle," "bottle portion," or "bottle half" for containing liquid. Rather, the word "container" in the present disclosure and in the appended claims can also mean a "box," "packet," "bag," "portion of a bag," "pocket of a bag," or any such deformable structure for containing liquid.

As used in the present disclosure and in the appended claims, the word "channel" does not necessarily refer to a tunnel, straw, tube, bore, or other such elongated structure for conveying liquid. Rather, the word "channel" in this description and in the appended claims can also refer to an "opening," or any such structure for conveying liquid. As used in the present disclosure and in the appended claims, the word "chamber" can refer to a cup having an open mouth for drinking or can refer to an enclosed compartment having an opening or orifice for drinking.

The present disclosure proposes to provide an improved sports bottle. It is a more particular object of the present disclosure to provide an improved sports bottle which is quickly and easily refillable with two different liquids. It is a still more particular object of the present disclosure to provide an improved sports bottle which is quickly and easily refillable and which effectively prevents the mixture of liquids when dispensed from the bottle by a user.

The present disclosure proposes to provide dual compartment pouches/chambers/channels suitable for selectively dispensing two different fluids (e.g., different beverages) from the same container. Such selective dispensing requires a chamber design that allows for manipulation of the compartments individually. This allows the consumer to selectively dispense and consume fluids separately, without the possibility of inadvertently mixing the liquids. The present disclosure also proposes a method for manufacturing a bottle having dual chambers that prevents the inadvertent mixing of liquids.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a perspective view of a dual-chambered drinking bottle having two volumetrically equal-sized chambers, in accordance with the present disclosure. The dual chamber bottle 10 includes a body or cylindrical enclosure 12, a first chamber 14, a second chamber 16, a base portion 18, a top portion 20, a first ridge 22, a second ridge 24, a gap portion 26, a first orifice 28, a first bottle neck 30, a first strap 32, a second orifice 34, a second bottle neck 36, and a second strap 38. The dual chamber bottle 10 further includes a first liquid 11, a second liquid 13, and a dividing wall 21.

Dual chamber bottle 10 includes a body 12 that is preferably formed of a hollow molded plastic material that defines two substantially cylindrical liquid chambers 14, 16 and has a base portion 18. The bottle 10 includes a first chamber 14 for holding a first liquid 11 and a second chamber 16 for holding a second liquid 13, where the first liquid 11 is preferably different than the second liquid 13. It will be apparent to those skilled in the art that the diameters and/or heights of the first chamber 14 and the second chamber 16 and/or the body 12 may be selected in accordance with design preferences.

The dividing wall 21 extends vertically from the base portion 18, extending through the body 12 and ending at the gap portion 26 (explained below) forming two ridges (e.g., a first ridge 22 and a second ridge 24). The dividing wall 21 provides a means for separating the first chamber 14 from the second chamber 16. Applying pressure to one side of the body 12 allows the first liquid 11 of the first chamber 14 to be forced out of the compartment and into the mouth of a user through the first orifice 28. The dividing wall 21 prevents the pressure exerted on the first chamber 14 to be transferred to the second chamber 16, thus allowing the user to selectively dispense the contents/liquids of each individual chamber/container/compartment into the mouth of a user via a channel (e.g., first orifice 18, second orifice 34).

The body 12 may further define an inwardly extending reduced first bottle neck 30 and an inwardly extending reduced second bottle neck 36 with the top portion 20. The first bottle neck 30 connects the first orifice 28 to the first chamber 14, whereas the second bottle neck 36 connects the second orifice 34 to the second chamber 16. As described, the top portion 20 may terminate via the first bottle neck 30 and the second bottle neck 36 to a first orifice 28 and a second orifice 34, respectively. However, any type of channel may be used, as contemplated by one skilled in the art. For example, each orifice may be replaced by an elongated, substantially cylindrical straw. The straw may be formed of a relatively rigid tubular plastic material or the like.

The gap portion 26 provides for the effective separation of the first liquid 11 contained in the first chamber 14 from the second liquid 13 contained in the second chamber 16. It is envisioned that the gap portion 26 may be of any reasonable and/or suitable vertical or horizontal length and may be adapted to conform to the height of the first chamber 14 and/or the second chamber 16.

The gap portion 26 prevents the fluid communication between the first chamber 14 and the second chamber 16. The gap portion 26 allows for (i) fluid communication between the first chamber 14 and the first orifice 28 via the first bottle neck 30 and (ii) fluid communication between the second chamber 16 and the second orifice 34 via the second bottle neck 36. The gap portion 26 does not allow fluid communication between the first orifice 28 and the second chamber 16, nor between the second orifice 34 and the first chamber 14.

The gap portion 26 allows for two separate bottle necks (i.e., 30, 36) for preventing the mixing of liquid 11 and liquid 13 located in the first chamber 14 and the second chamber 16, respectively. The gap portion 26 does not permit the first bottle neck 30 and the second bottle neck 36 to come into contact with each other in order to prevent liquid 11 from coming into contact with liquid 13. As a result of the gap portion 26, the upper portion of the first chamber 14 has a smaller width than the lower portion of the first chamber 14. In addition, as a result of the gap portion 26, the upper portion of the second chamber 16 has a smaller width than the lower portion of the second chamber 16. The gap portion 26 allows for the height of the dividing wall 21 to be less than the overall height of the body 12. Also, the connecting point of the first ridge 22 and the second ridge 24 is configured to be a maximum height of the dividing wall 21. It is envisioned that the top portion 20 (the rim of the body 12) may wholly extend around the gap portion 26 or may extend partially around the gap portion 26. In other words, the outer perimeter of the gap portion 26 may have an outer wall enclosing the gap portion 26. The top portion 20 may extend wholly around the gap portion 26, the first chamber 14, and the second chamber 16 in order to better secure a cap (further described with reference to FIG. 3).

Optionally, the first neck portion 30 is connected to the body 12 by means of a first lid strap 32 extending between the first bottle neck 30 and the body 12. Optionally, the second bottle neck 36 is connected to the body 12 by means of a second strap 38 extending between the second bottle neck 36 and the body 12. The first strap 32 and the second strap 38 may provide for a permanent connection between the bottle necks 30, 36 and the body 12 so that the two components remain connected to each other at all times. In some applications, by providing a separate strap for each bottle neck portion, allows a user to access one chamber while keeping the other chamber inaccessible.

In operation, the user of the dual chamber bottle 10 can conveniently draw a liquid from the bottle 10 through either the first orifice 28 or the second orifice 34 while maintaining effective separation of the liquids 11 and 13. In operation, the first orifice 28 would be placed in the mouth of a user, who would squeeze the bottle 10 to eject the first liquid 11 from the first chamber 14. Alternately, the second orifice 34 would be placed in the mouth of a user, who would squeeze the bottle 10 to eject the second liquid 13 from the second chamber 16. In operation, the gap portion 26 would separate the upper portions of each chamber 14, 16 in order to prevent the inadvertent mixture of liquids. The separation of the first bottle neck 30 from the second bottle neck 36 via a gap portion 26 that may vary between a few millimeters to 1-2 inches, via a first ridge 22 and a second ridge 24, enables a user to drink two separate liquids, without mixing the liquids.

It will be apparent to those skilled in the art that this separation of liquids via the gap portion 26 offers a substantial advantage by providing the capability to drink more than one liquid without inadvertently mixing the liquids 11, 13.

Figure 1A:
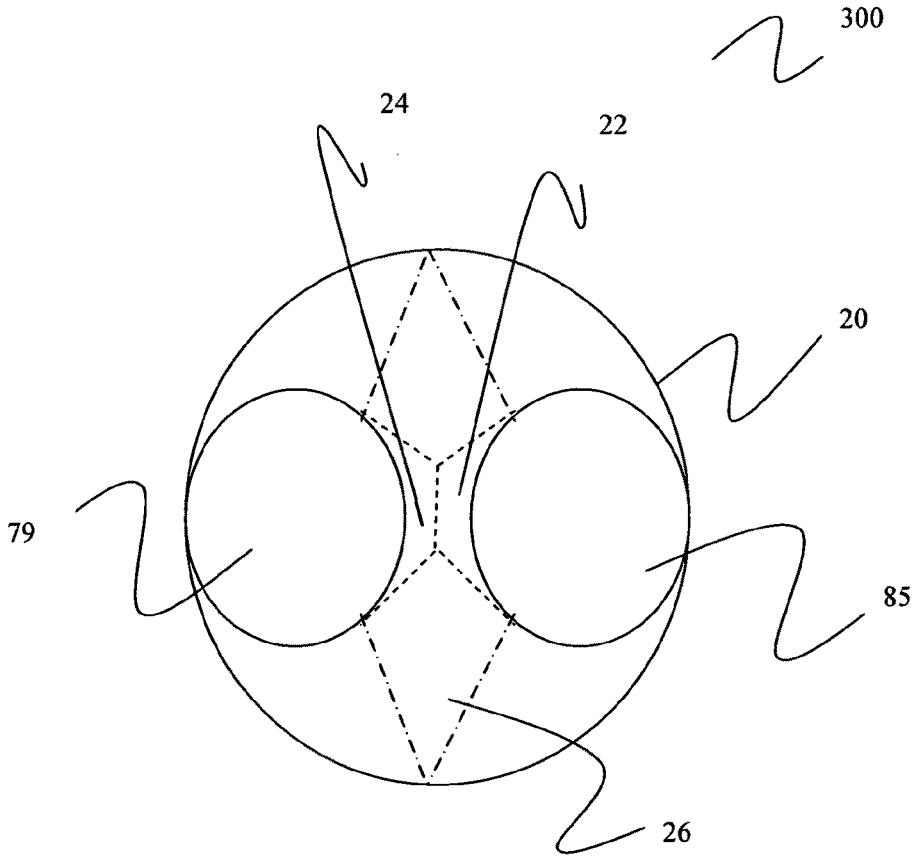
FIG. 1A is a top view of the dual-chambered drinking bottle having two volumetrically equal-sized chambers of FIG. 1, in accordance with the present disclosure.

With reference to FIG. 1A, there is a presented a top view of the dual-chambered drinking bottle having two volumetrically equal-sized chambers of FIG. 1, in accordance with the present disclosure. The top view 300 of the dual chamber bottle 10 includes similar elements to FIG. 1. Specifically, the top view 300 includes the top portion 20, the first ridge 22, the second ridge 24, and the gap portion 26. In addition, the top view 300 includes elements 79 and 85 described with reference to FIG. 4 below.

FIG. 1A illustrates how the gap portion 26 separates the first bottle neck 30 from the second bottle neck 36 by providing for a first ridge 22 and a second ridge 24. The connecting point of the first ridge 22 and the second ridge 24 is the upper portion of the dividing wall 21. The separation of the upper portions of the chambers 14, 16 effectively provides for the separation of the liquids 11, 13 when desired to be separately accessed by a user of the bottle 10. The upper portion of the first chamber 14 ends at the first orifice 28, whereas the upper portion of the second chamber 16 ends at the second orifice 34. The first bottle opening 79 (the rim of the upper portion of the first chamber 14) and the second bottle opening 85 (the rim of the upper portion of the second chamber 16) are prevented from coming into contact with each other, thus forming a gap portion 26 to effectively separate the liquids 11, 13 during the storing and dispensing processes.

Figure 2:
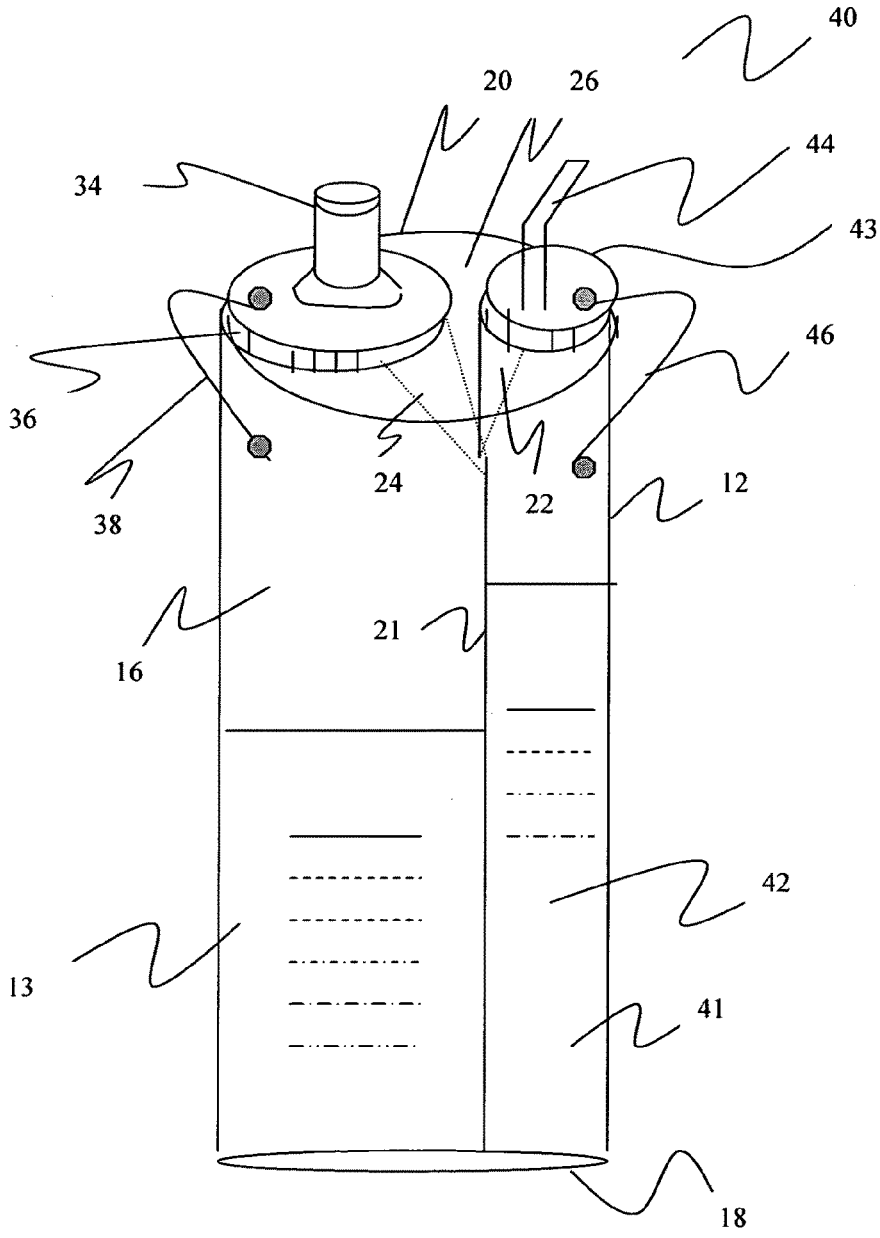
FIG. 2 is a perspective view of a dual-chambered drinking bottle having two volumetrically non-equal-sized chambers, in accordance with the present disclosure.

With reference to FIG. 2, there is presented a perspective view of a dual-chambered drinking bottle having two volumetrically non-equal-sized chambers, in accordance with the present disclosure. The dual chamber bottle 40 includes a first chamber 42, a straw 44, and a first strap 46. The dual chamber bottle 40 further includes a first liquid 41 and a first bottle neck 43. Additionally, the dual chamber bottle 40 includes similar elements to FIG. 1. These similar elements include a body or cylindrical enclosure 12, a second chamber 16, a base portion 18, a top portion 20, a first ridge 22, a second ridge 24, a gap portion 26, a second orifice 34, a second bottle neck 36, a second strap 38, a second liquid 13, and a dividing wall 21.

The bottle 40 illustrates that the chambers 42, 16 can be of different volumetric size. In other words, the first chamber 42 may be smaller than the second chamber 16 (or vice versa). In addition, the first orifice 44 may be a different design than the second orifice 34. For example, the first orifice 44 may be a straw configuration, whereas the second orifice 34 may be a cap configuration. Of course, one skilled in the art can contemplate any combination of different types of orifices that are reasonable and/or suitable to such bottle 40. The volumetric size of each chamber 42, 16 may be determined by one or more desired applications.

In FIG. 1, the first chamber 14 had approximately the same volumetric size as the second chamber 16. In contrast, in FIG. 2, the first chamber 14 has a different volumetric size than the second chamber 16. In addition, the height of the first chamber 14 and the second chamber 16 is approximately the same in both FIGS. 1 and 2. However, the height of the first chamber 14 and the second chamber 16 can be of a different size, as described below with reference to FIG. 7.

Optionally, one or more bottle neck portions may be connected to the body 12 by means of one or more straps (e.g., 38) extending between the one or more bottle neck portions and the body 12. The one or more straps (e.g., 38) may provide for a permanent connection between the bottle neck portions and the body 12 so that the components remain connected to each other at all times. In some applications, by providing a separate strap for each bottle neck portion, allows a user to access one chamber while keeping the other chamber inaccessible.

Figure 3:
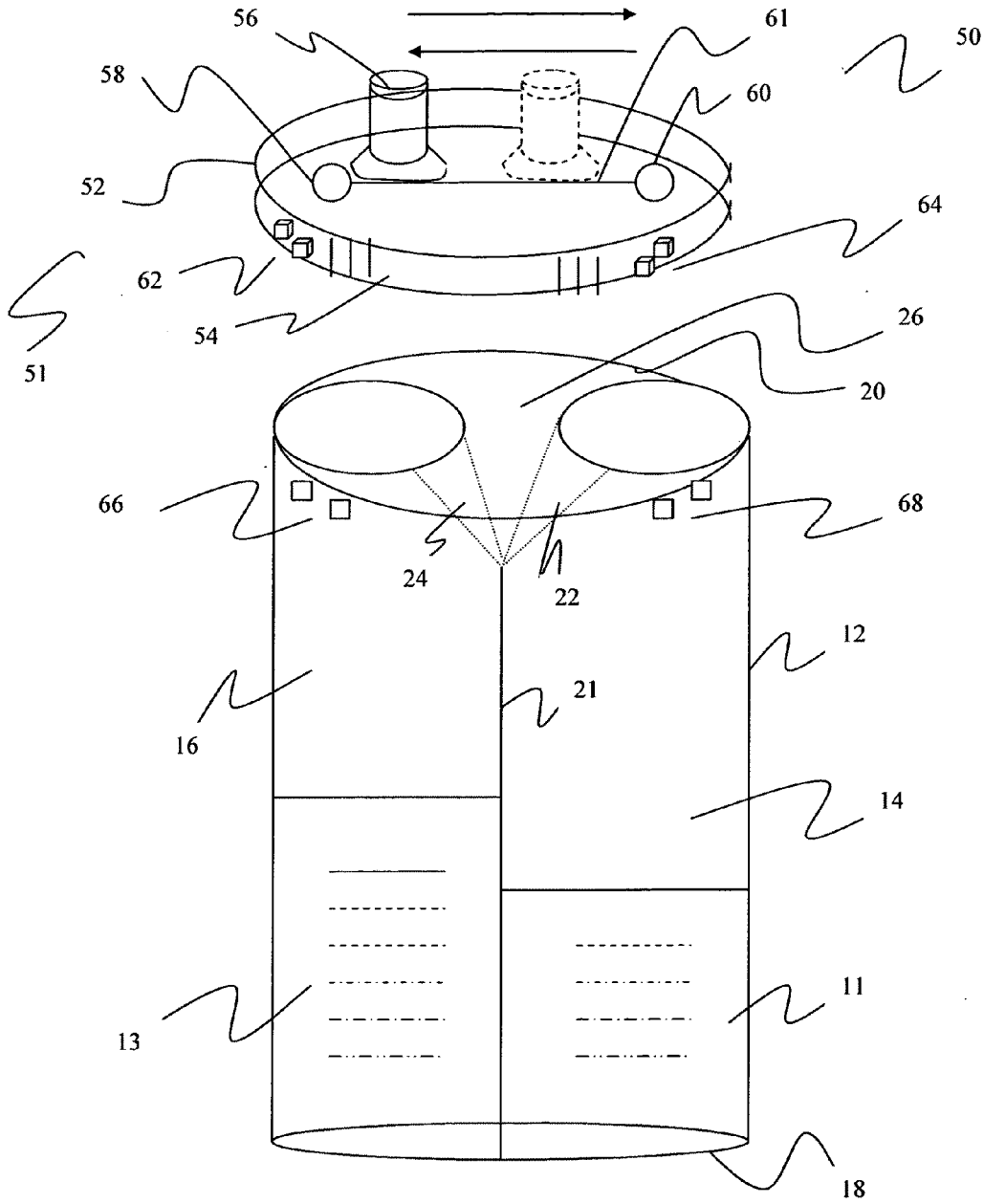
FIG. 3 is a perspective view of the dual-chambered drinking bottle having one lid with a slidable orifice, in accordance with the present disclosure.

With reference to FIG. 3, there is presented a perspective view of the dual-chambered drinking bottle having one lid with a slidable orifice, in accordance with the present disclosure. The bottle 50 having a first embodiment of a cap 51 includes a top portion 52, an annular skirt 54, an orifice 56, a first connection portion 58, a second connection portion 60, a first latching projection 62, a second latching projection 64, a first orientation recess 66, and a second orientation recess 68. The bottle 50 further includes a slidable track 61. Additionally, the bottle 50 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first liquid 11, a second liquid 13, and a dividing wall 21.

The body 12 has a lid or cap 51 that is releasably coupled to the top portion 20 of the bottle 50. The shape and dimensions of the cap or lid 51 may be adapted to those of the body 12 such that the cap or lid 51 can be placed onto the body 12 for repeatedly sealing the first chamber 14 and the second chamber 16. The body 12 may further define an inwardly extending reduced diameter neck (not shown) with the top portion 20. The neck may be an external threaded neck for allowing rotational engagement with the cap 51 having interior threads, notches or teeth arranged to match the exterior threads of the neck. In addition, the annular skirt 54 may have interior threads, notches or teeth adapted to match the threads of a neck. Thus, the lid or cap 51 may be coupled to the top portion 20 of the body 12 by using any suitable fastening mechanism, such as a threaded fastening mechanism or a snap-fit fastening mechanism.

In a first embodiment of the cap 51, the cap 51 includes an orifice 56 which is slidably movable across the surface of the cap 51. The orifice can slidably move between the first connection portion 58 and the second connection portion 60. A clicking or snapping mechanism may be engaged to secure the orifice 56 to either the first connection portion 58 or the second connection portion 60. The first connection portion 58 and the second connection portion 60 are fixed points on the cap 51.

The orifice 56 may slidably move between the first connection portion 58 and the second connection portion 60 by means of or via the slidable track 61. The slidable track 61 ensures that the orifice 56 moves in a predetermined or predesignated path along the surface of the cap 51. The slidable function allows the user of the bottle 50 to readily switch between the first chamber 14 and the second chamber 16 to selectively access either liquid 11 or liquid 13. The arrows indicate that the orifice 56 can move in a horizontal direction. However, it is contemplated that the path may not be a linear path. The path may be a circular path or a zigzag path or any other type of path that may be contemplated for moving the orifice 56 over the surface of cap 51.

Additionally, the annular skirt 54 may include one or more sets of a first latching projection 62 and a second latching projection 64. These latching projections 62, 64 allow the cap 51 to be fixedly secured to the body 12 of the bottle 50 via the first orientation recess 66 and the second orientation recess 68 located on the body 12. The latching projections may be spaced out as single units or may be spaced out as sets of two, three, or more. Any number of latching projections may be employed to secure the cap 51 to the body 12. The latching projections and the orientation recesses may be any shape or size contemplated by one skilled in the art.

In contrast to FIGS. 1 and 2, in FIG. 3 there is only one movable orifice 56 connected to only one neck portion. In FIGS. 1 and 2, there are two orifices that are fixed to two neck portions. Of course, one skilled in the art can contemplate any different type of orifice that is reasonable and/or suitable to such bottle 50. In addition, the first connection point 58 and the second connection point 60 may be any type of connection contemplated by one skilled in the art (e.g., snapping connection, threaded connection, latching connection, sliding connection, etc.).

As in FIGS. 1 and 2, the gap portion 26 provides for the effective separation of the first liquid 11 contained in the first chamber 14 from the second liquid 13 contained in the second chamber 16. It is envisioned that the gap portion 26 may be of any reasonable and/or suitable vertical or horizontal length and may be adapted to conform to the height of the first chamber 14 and/or the second chamber 16.

As in FIGS. 1 and 2, the gap portion 26 prevents the fluid communication between the first chamber 14 and the second chamber 16. The gap portion 26 allows for (i) fluid communication between the first chamber 14 and the first orifice 28 via the first bottle neck 30 and (ii) fluid communication between the second chamber 16 and the second orifice 34 via the second bottle neck 36. The gap portion 26 does not allow fluid communication between the first orifice 28 and the second chamber 16, nor between the second orifice 34 and the first chamber 14.

As in FIGS. 1 and 2, the gap portion 26 allows for two separate bottle necks (i.e., 30, 36) for preventing the mixing of liquid 11 and liquid 13 located in the first chamber 14 and the second chamber 16, respectively. The gap portion 26 does not permit the first bottle neck 30 and the second bottle neck 36 to come into contact with each other in order to prevent liquid 11 from coming into contact with liquid 13. As a result of the gap portion 26, the upper portion of the first chamber 14 has a smaller width than the lower portion of the first chamber 14. In addition, as a result of the gap portion 26, the upper portion of the second chamber 16 has a smaller width than the lower portion of the second chamber 16. The gap portion 26 allows for the height of the dividing wall 21 to be less than the overall height of the body 12. Also, the connecting point of the first ridge 22 and the second ridge 24 is configured to be a maximum height of the dividing wall 21.

It is envisioned that the top portion 20 (the rim of the body 12) may wholly extend around the gap portion 26 or may extend partially around the gap portion 26. In other words, the outer perimeter of the gap portion 26 may have an outer wall enclosing the gap portion 26. The top portion 20 may extend wholly around the gap portion 26, the first chamber 14, and the second chamber 16 in order to better secure a cap.

Optionally, one or more bottle neck portions may be connected to the body 12 by means of one or more straps (not shown) extending between the one or more bottle neck portions and the body 12. The one or more straps may provide for a permanent connection between the bottle neck portions and the body 12 so that the components remain connected to each other at all times.

Figure 4:
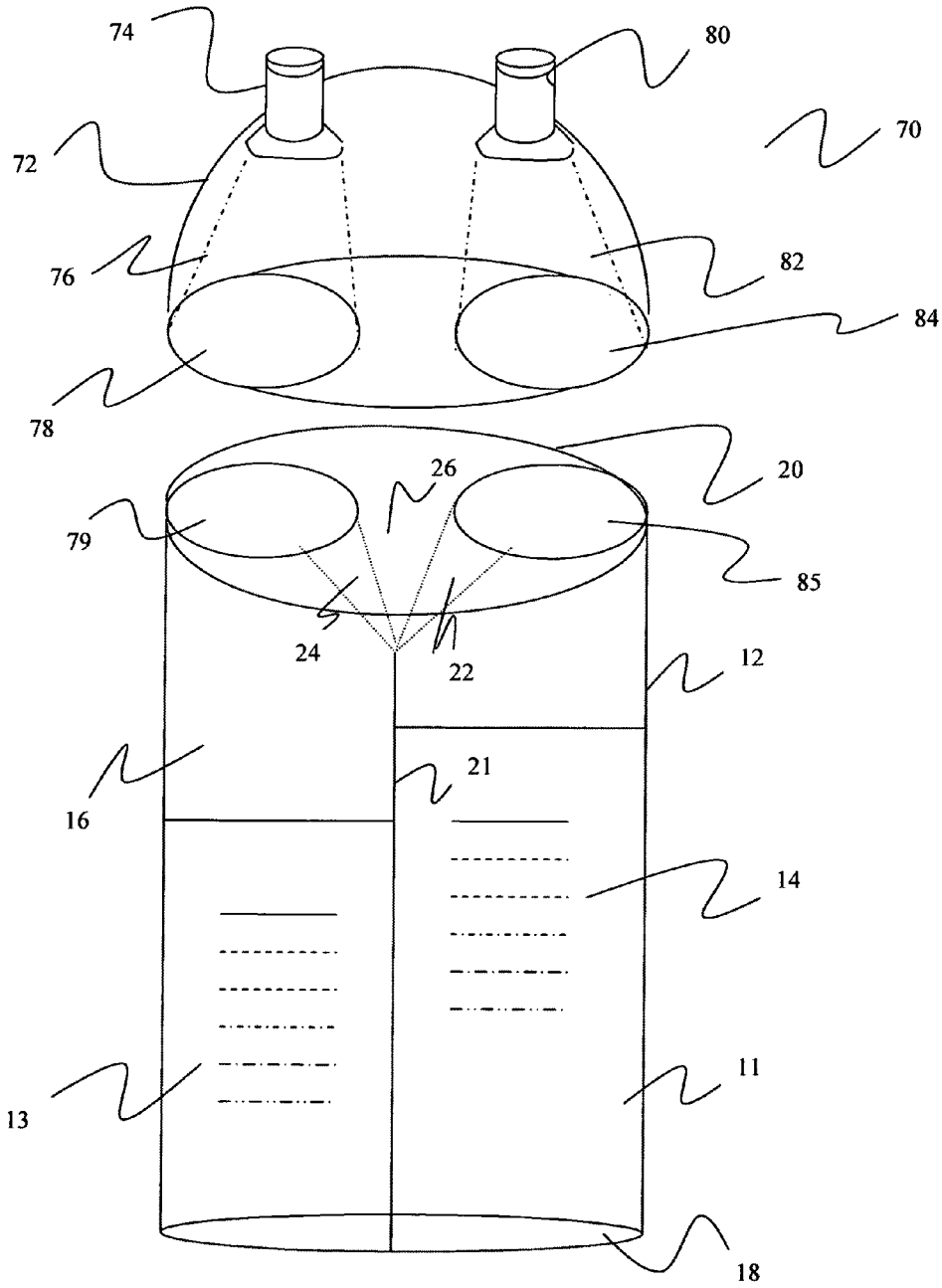
FIG. 4 is a perspective view of the dual-chambered drinking bottle having one lid with two orifices, in accordance with the present disclosure.

With reference to FIG. 4, there is presented a perspective view of the dual-chambered drinking bottle having one lid with a two orifices, in accordance with the present disclosure. The bottle 70 having a second embodiment of a cap includes a cap 72, a first orifice 74, a first connecting member 76, a first cap opening 78, a second orifice 80, a second connecting member 82, and a second cap opening 84. The bottle 70 further includes a first bottle opening 79 and a second bottle opening 85. Additionally, the bottle 70 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first liquid 11, a second liquid 13, and a dividing wall 21.

The body 12 has a lid or cap 72 that is releasably coupled to the top portion 20 of the bottle 70. The shape and dimensions of the cap or lid 72 may be adapted to those of the body 12 such that the cap or lid 72 can be placed onto the body 12 for repeatedly sealing the first chamber 14 and the second chamber 16. The body 12 may further define an inwardly extending reduced diameter neck (not shown) with the top portion 20. The neck may be an external threaded neck for allowing rotational engagement with the cap 72 having interior threads, notches or teeth arranged to match the exterior threads of the neck. The lid or cap 72 may be coupled to the top portion 20 by using any suitable fastening mechanism, such as a threaded fastening mechanism or a snap-fit fastening mechanism.

In the second embodiment of the cap 72, the cap 72 is molded into a dome shape including a first orifice 74 and a second orifice 80. The first orifice 74 is attached to a first connecting member 76 that extends through the dome-shape of the cap 72 up to a first cap opening 78. The second orifice 80 is attached to a second connecting member 82 that extends through the dome-shape of the cap 72 up to a second cap opening 84. The dome-shaped cap 72 can be any reasonable and/or suitable size for securedly fitting onto the body 12 of the bottle 70. The first cap opening 78 is designed so that it securedly fits onto the first bottle opening 79 and the second cap opening 84 is designed so that it securedly fits onto the second bottle opening 85. The cap 72 can be fixedly secured to the body 12 in only two ways in order to properly be affixed. As shown, the first orifice configuration (74, 76, 78) and the second orifice configuration (80, 82, 84) are fixed into the dome-shaped cap 72.

Figure 5:
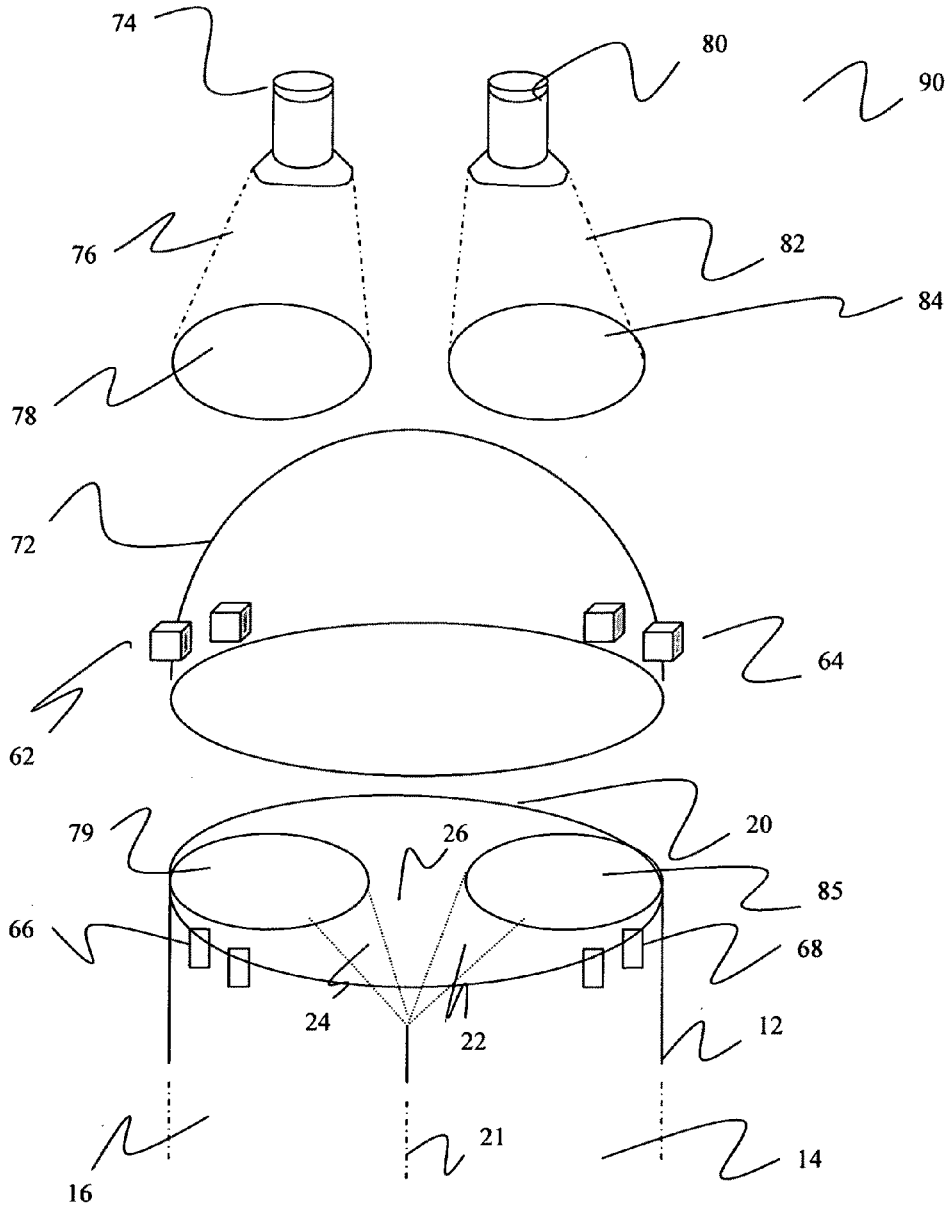
FIG. 5 is an exploded view of the dual-chambered drinking bottle having one lid with two orifices of FIG. 4, in accordance with the present disclosure.

Additionally, as in FIG. 3, FIG. 4 may include an annular skirt that has one or more sets of latching projections (see FIG. 5). These latching projections allow the cap 72 to be fixedly secured to the body 12 of the bottle 70 via the plurality of orientation recess located on the body 12. The latching projections may be spaced out as single units or may be spaced out as sets of two, three, or more. Any number of latching projections may be employed to secure the cap 72 to the body 12. The latching projections and the orientation recesses may be any shape or size contemplated by one skilled in the art.

Optionally, one or more bottle neck portions may be connected to the body 12 by means of one or more straps (not shown) extending between the one or more bottle neck portions and the body 12. The one or more straps may provide for a permanent connection between the bottle neck portions and the body 12 so that the components remain connected to each other at all times.

With reference to FIG. 5, there is presented an exploded view of the dual-chambered drinking bottle having one lid with a two orifices of FIG. 4, in accordance with the present disclosure. FIG. 5 illustrates an exploded view 90 of the bottle 70 of the present disclosure. Additionally, the exploded view 90 includes similar elements to FIGS. 1, 3 and 4. These similar elements include (FIG. 1) a body or cylindrical enclosure 12, a first chamber 14, a second chamber 16, a base portion 18, a top portion 20, a first ridge 22, a second ridge 24, a gap portion 26, and a dividing wall 21. These similar elements further include (FIG. 3) a first latching projection 62, a second latching projection 64, a first orientation recess 66, and a second orientation recess 68. These similar elements further include (FIG. 4) cap 72, a first orifice 74, a first connecting member 76, a first cap opening 78, a second orifice 80, a second connecting member 82, a second cap opening 84, a first bottle opening 79, and a second bottle opening 85.

The exploded view 90 of the bottle 70 described in FIG. 4 merely illustrates how the first orifice configuration (74, 76, 78) and the second orifice configuration (80, 82, 84) connect to the dome-shaped cap 72 that includes a plurality of latching projections (62, 64), which in turn connect to a plurality of orientation recesses (66, 68) of the body 12. The first orifice configuration (74, 76, 78) and the second orifice configuration (80, 82, 84) are fixedly secured within the dome-shaped cap 72 in order to provide a user of bottle 70 with the ability to selectively drink from either the first orifice 74 or the second orifice 80.

Figure 6:
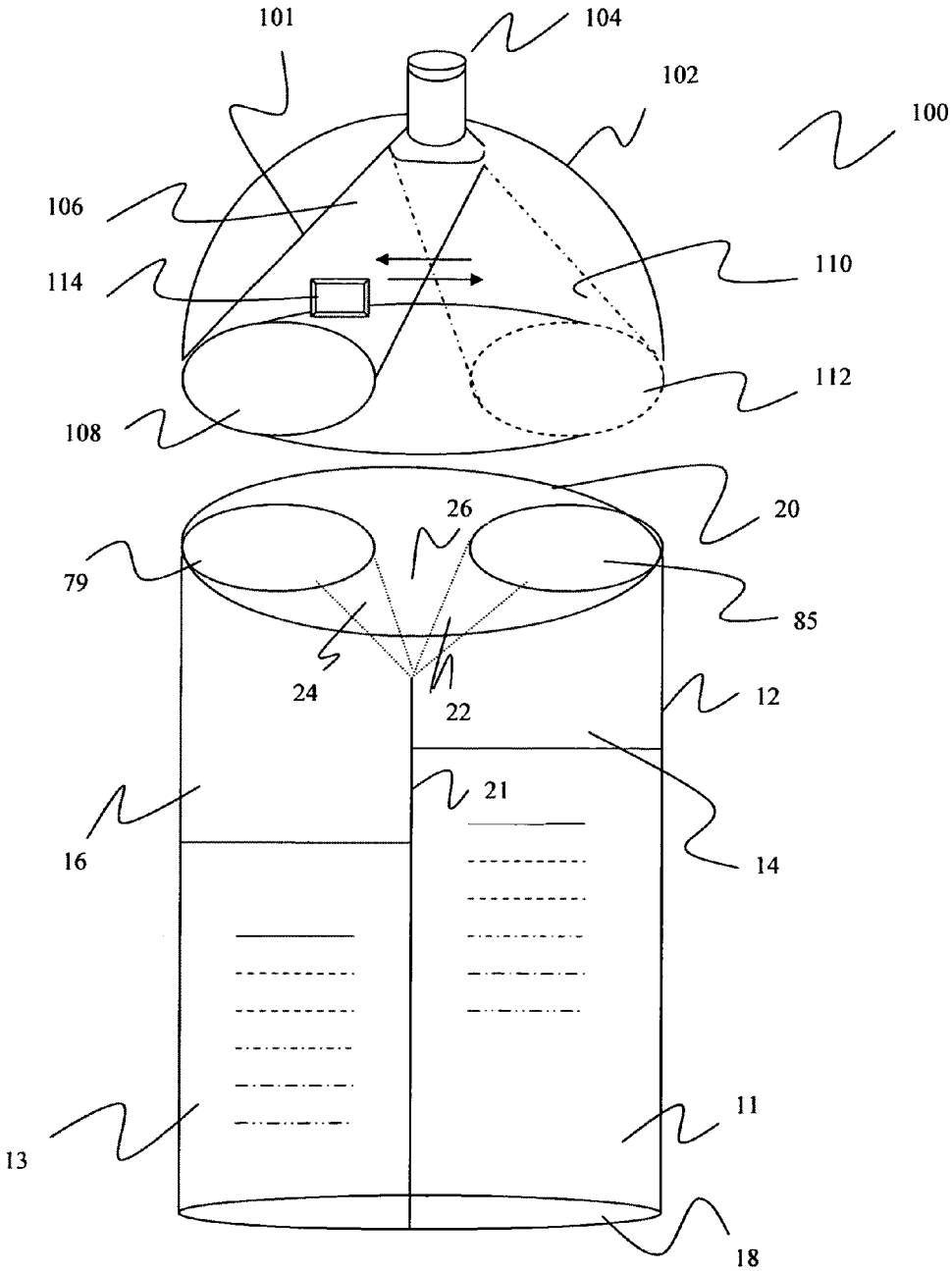
FIG. 6 is a perspective view of the dual-chambered drinking bottle having one lid with one switchable orifice, in accordance with the present disclosure.

With reference to FIG. 6, there is presented a perspective view of the dual-chambered drinking bottle having one lid with a one switchable orifice, in accordance with the present disclosure. The bottle 100 having a third embodiment of a cap includes a cap 102, an orifice 104, a connecting member 101, a first position of a connecting member 106, a first position of a cap opening 108, a second position of a connecting member 110, a second position of a cap opening 112, and a switch 114. Additionally, the bottle 100 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first liquid 11, a second liquid 13, and a dividing wall 21. Additionally, the bottle 100 includes similar elements to FIG. 4. These similar elements include a first bottle opening 79 and a second bottle opening 85.

In the third embodiment of the cap 102, the body 12 has a lid or cap 102 that is releasably coupled to the top portion 20 of the bottle 100. The shape and dimensions of the cap or lid 102 may be adapted to those of the body 12 such that the cap or lid 102 can be placed onto the body 12 for repeatedly sealing the first chamber 14 and the second chamber 16. The body 12 may further define an inwardly extending reduced diameter neck (not shown) with the top portion 20. The neck may be an external threaded neck for allowing rotational engagement with the cap 102 having interior threads, notches or teeth arranged to match the exterior threads of the neck. The lid or cap 102 may be coupled to the top portion 20 by using any suitable fastening mechanism, such as a threaded fastening mechanism or a snap-fit fastening mechanism.

In the third embodiment of the cap, the cap 102 is molded into a dome shape including a single orifice 104. The orifice 104 is attached to a single connecting member 101 that extends through the dome-shape of the cap 102 up to a cap opening (108 or 112). The connecting member 101 can be moved from a first position 106 of the connecting member 101 to a second position 110 of the connecting member 101. The first position 106 of the connecting member 101 ends at a first cap position opening 108 and the second position 110 of the connecting member 101 ends at a second cap position opening 112.

A switch 114 enables the connecting member 101 to move between the first position 106 and the second position 110. The switch 114 may be mounted/located/positioned on any past of the surface of the dome-shaped cap 102. Preferably, the switch 114 is located on the lower edge of the bottom portion of the dome-shaped cap 102.

The dome-shaped cap 102 can be any reasonable and/or suitable size for securedly fitting onto the body 12 of the bottle 100. The first cap position opening 108 is designed to be fixedly secured to the first bottle opening 79, whereas the second cap position 112 is designed to be fixedly secured to the second bottle opening 85. The cap 102 can be fixedly secured to the body 12 in only two ways in order to properly be affixed. In other words, the first cap position opening 108 and the second position 110 cap 102 are designed to coincide with the first bottle opening 79 and the second bottle opening 85.

The orifice 104 remains in a fixed position on the dome-shaped cap 102. However, the connecting member 101 shifts between two positions (i.e., between cap opening 108 and cap opening 112) in order to allow individual and separate access to first bottle opening 79 and second bottle opening 85. This configuration, as all other configurations of the present disclosure, in combination with the gap portion 26, prevents the inadvertent mixture of liquids 11, 13.

Additionally, as in FIG. 3, FIG. 6 may include an annular skirt that has one or more sets of latching projections. These latching projections allow the cap 102 to be fixedly secured to the body 12 of the bottle 100 via the plurality of orientation recess located on the body 12. The latching projections may be spaced out as single units or may be spaced out as sets of two, three, or more. Any number of latching projections may be employed to secure the cap 102 to the body 12. The latching projections and the orientation recesses may be any shape or size contemplated by one skilled in the art.

Optionally, one or more bottle neck portions may be connected to the body 12 by means of one or more straps (not shown) extending between the one or more bottle neck portions and the body 12. The one or more straps may provide for a permanent connection between the bottle neck portions and the body 12 so that the components remain connected to each other at all times.

Figure 7:
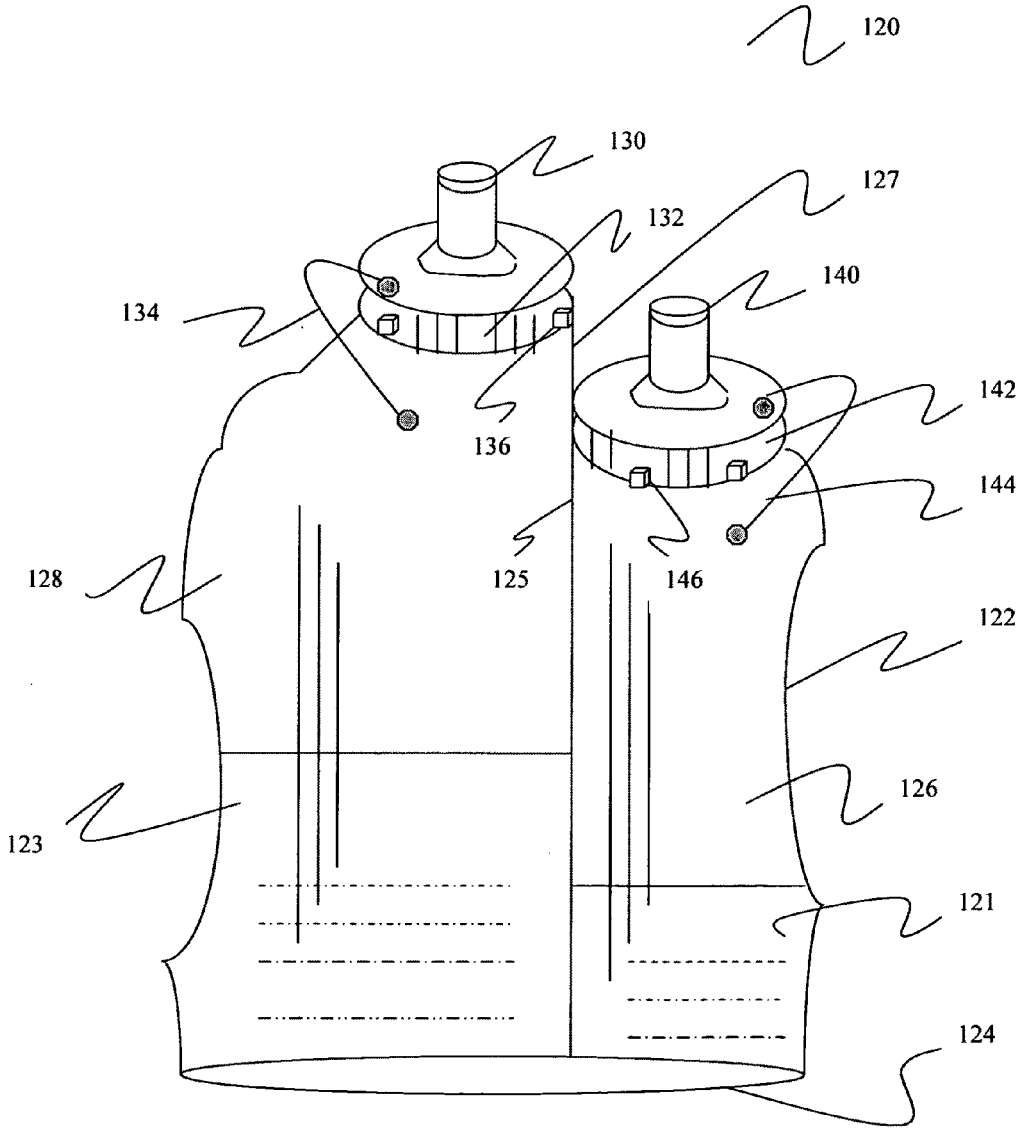
FIG. 7 is a perspective view of the dual-chambered drinking bottle having chambers of different heights, in accordance with the second embodiment of the present disclosure.

With reference to FIG. 7, there is presented a perspective view of the dual-chambered drinking bottle having chambers of different heights, in accordance with the second embodiment of the present disclosure. The bottle 120 includes a body 122, a base portion 124, a first chamber 126, a second chamber 128, a first orifice 140, a first bottle neck 142, a first lid strap 144, a set of latching projections 136, a second orifice 130, a second bottle neck 132, a second lid strap 134, and a set of orientation recesses 146. The bottle 120 further includes a first liquid 121, a second liquid 123, a dividing wall 125, and an upper wall 127.

In the second embodiment of the present disclosure the dual chamber bottle 120 includes a body 122 that is preferably formed of a hollow molded plastic material that defines two liquid chambers 126, 128 and has a base portion 124. The bottle 120 includes a first chamber 126 for holding a first liquid 121 and a second chamber 128 for holding a second liquid 123, where the first liquid 121 is preferably different than the second liquid 123. It will be apparent to those skilled in the art that the diameters of the first chamber 126 and the second chamber 128 may be selected in accordance with design preferences.

The dividing wall 125 extends vertically from the base portion 124, extending through the body 122 and ending at a height, equal to the height of the shortest chamber. The dividing wall 125 provides a means for separating the first chamber 126 from the second chamber 128. Applying pressure to one side of the body 122 allows the first liquid 121 of the first chamber 126 to be forced out of the compartment and into the mouth of a user through the first orifice 140. The dividing wall 125 prevents the pressure exerted on the first chamber 126 to be transferred to the second chamber 128, thus allowing the user to selectively dispense the contents/liquids of each individual chamber/container/compartment into the mouth of a user via a channel.

The body 122 may further define an inwardly extending reduced first bottle neck 142 and an inwardly extending reduced second bottle neck 132. The first bottle neck 142 connects the first orifice 140 to the first chamber 126, whereas the second bottle neck 132 connects the second orifice 130 to the second chamber 128. However, any type of orifice may be used, as contemplated by one skilled in the art. For example, each orifice may be replaced by an elongated cylindrical straw. The straw may be formed of a relatively rigid tubular plastic material or the like.

The upper wall 127 provides for a height differential between the first chamber 126 and the second chamber 128. This height differential ensures that the first liquid 121 and the second liquid 123 located in the first chamber 126 and the second chamber 128, respectively, do not come into contact when a user attempts to drink the liquids 121, 123. The height differential can vary from a few millimeters to a few inches depending on the application or aesthetics. The height of the dividing wall 125 is less than the overall height of the body 122. Also, the connecting point of the first chamber 126 and the second chamber 128 is configured to be a maximum height of the dividing wall 125.

Optionally, the first bottle neck 142 is connected to the body 122 by means of a first lid strap 144 extending between the first neck portion 142 and the body 122. Optionally, the second bottle neck 132 is connected to the body 122 by means of a second lid strap 134 extending between the second bottle neck 132 and the body 122. The first lid strap 144 and the second lid strap 134 may provide for a permanent connection between the bottle neck portions 142, 132 and the body 122 so that the two components remain connected to each other at all times. In some applications, by providing a separate lid strap for each neck portion, allows a user to access one chamber while keeping the other chamber inaccessible.

In operation, the user of the dual chamber bottle 120 can conveniently draw a liquid from the bottle 120 through either the first orifice 140 or the second orifice 130 while maintaining effective separation of the liquids 121 and 123. In operation, the first orifice 140 would be placed in the mouth of a user, who would squeeze the bottle 120 to eject the first liquid 121 from the first chamber 126. Alternately, the second orifice 130 would be placed in the mouth of a user, who would squeeze the bottle 120 to eject the second liquid 123 from the second chamber 128. In operation, the upper wall 127 would separate the neck portions 142, 132 of the chambers 126, 128 in order to prevent the mixture of liquids 121, 123.

It will be apparent to those skilled in the art that the diameters and the heights of the first chamber 126 and the second chamber 128 may be selected in accordance with design preferences. The diameters and the heights of the first chamber 126 and the second chamber 128 may vary anywhere between a few millimeters to a few inches.

It will be apparent to those skilled in the art that this separation of liquids 121, 123 via the upper wall 127 offers a substantial advantage by providing the capability to drink more than one liquid without inadvertently mixing the liquids.

Figure 8:
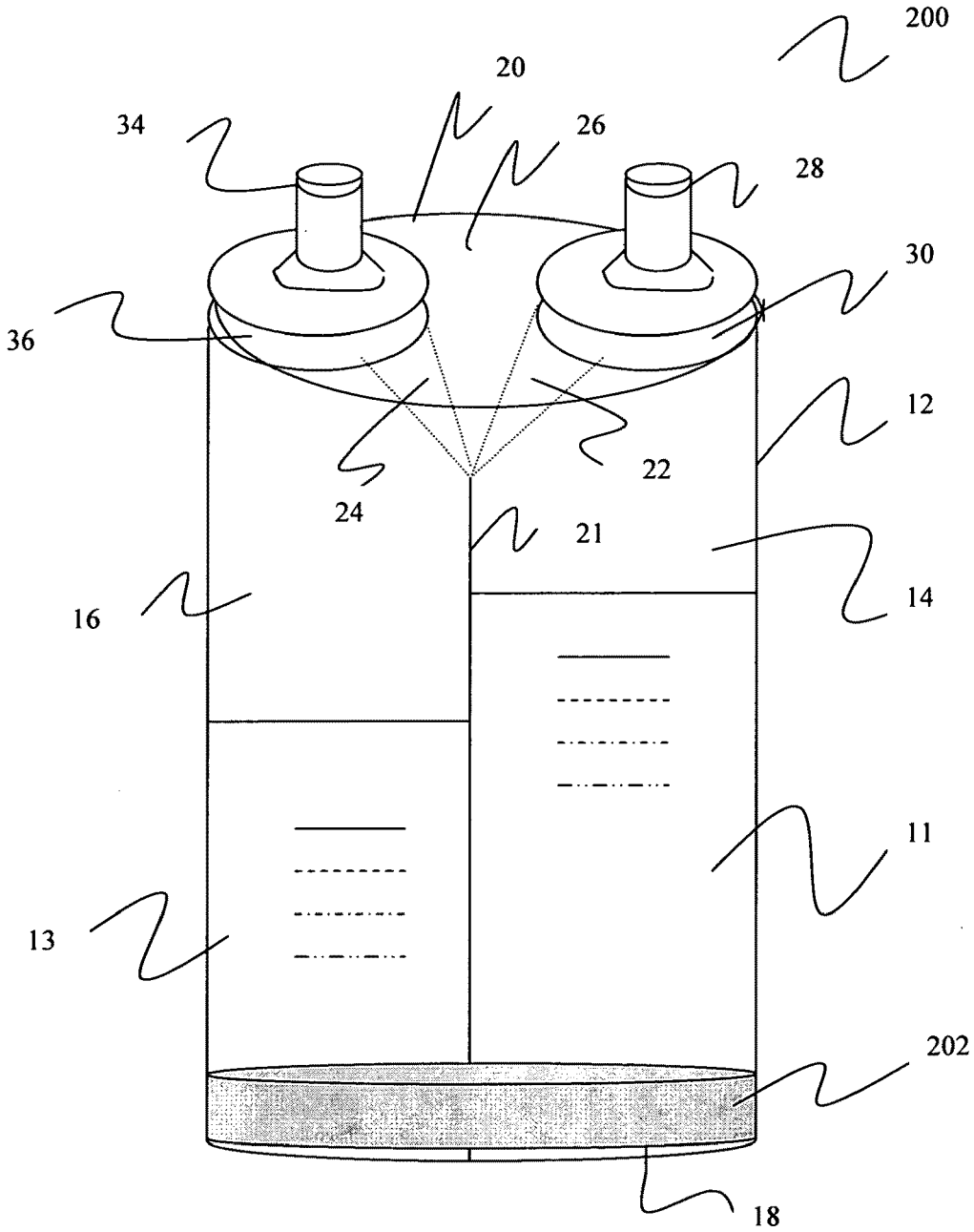
FIG. 8 is a perspective view of a dual-chambered drinking bottle having two volumetrically equal-sized chambers including one common cooling element, in accordance with the present disclosure.

With reference to FIG. 8, there is presented a perspective view of a dual-chambered drinking bottle having two volumetrically equal-sized chambers including one common cooling element, in accordance with the present disclosure. The bottle 200 includes a cooling element 202. Additionally, the bottle 200 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first orifice 28, a first bottle neck 30, a second orifice 34, a second bottle neck 36, a first liquid 11, a second liquid 13, and a dividing wall 21.

There are certain challenges that have developed in the use of sport bottles. For example, sport bottles are typically being utilized in an outdoor environment, which makes it very difficult to keep the contents cool. In most cases the sports bottle sits out in the sun or the hot air and rapidly loses the chilling effect of the liquid, with the result that an individual then have a warm liquid. This is highly undesirable as cool liquids are significantly more refreshing. In addition, with indoor health clubs/gyms being at room temperatures and warmer than preferred for a refreshing drink, many individuals may add ice to the drink to maintain it cooler. However, this can require time and effort in fitting the ice cubes individually into the bottle fill opening, and moreover dilutes all drinks other than water as the ice melts.

In FIG. 8 of the present disclosure, it is contemplated to use a single cooling element 202 positioned at the base portion 18 of the bottle 200. The cooling element 202 may be positioned in a separate compartment located at the bottom of both the first chamber 14 and the second chamber 16 in order to cool both liquids 11, 13 at the same time. It is noted that the cooling element 202 may be a removable cooling element that can be replaced at any time by the user of the bottle 200. The cooling element 202 may be any type of cooling element contemplated by one skilled in the art.

Figure 9:
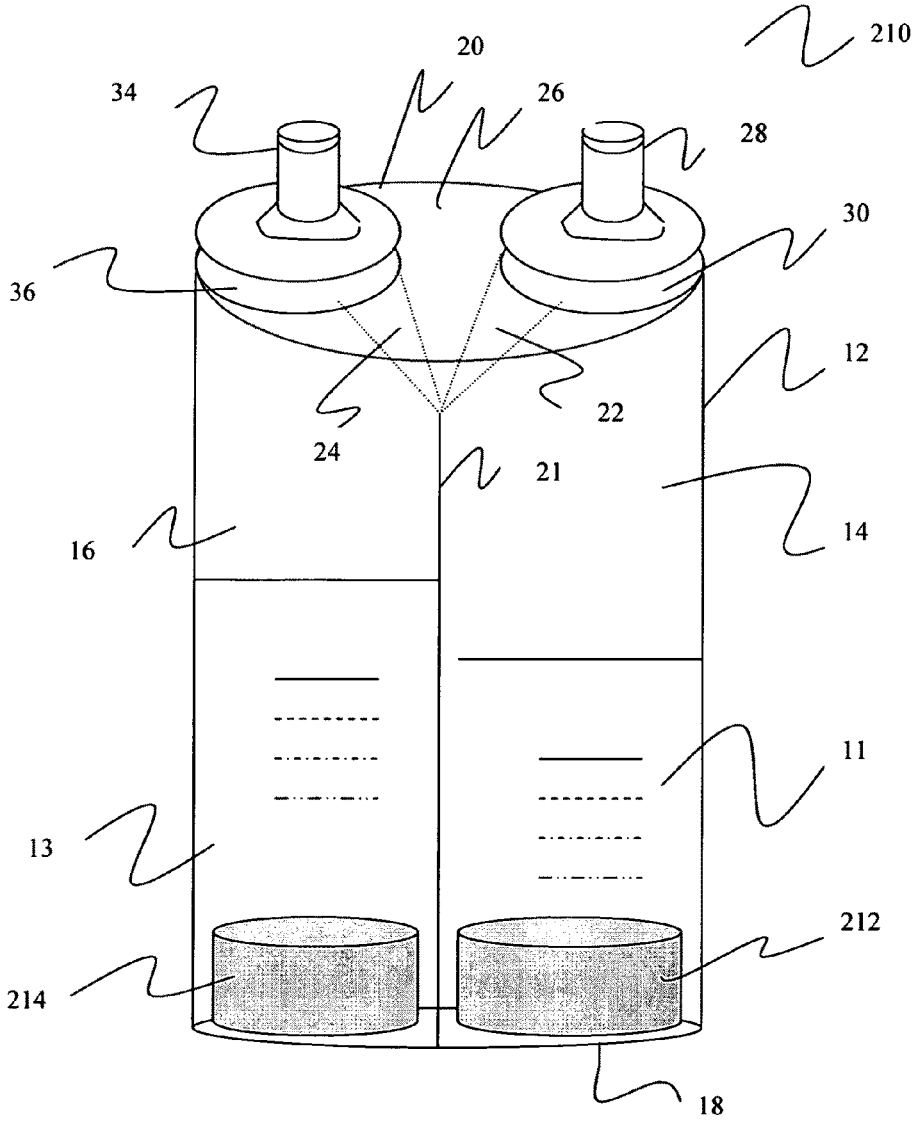
FIG. 9 is a perspective view of a dual-chambered drinking bottle having two volumetrically equal-sized chambers including two separate cooling elements located on a bottom portion of the bottle, in accordance with the present disclosure.

With reference to FIG. 9, there is presented a perspective view of a dual-chambered drinking bottle having two volumetrically equal-sized chambers including two separate cooling elements located on a bottom portion of the bottle, in accordance with the present disclosure. The bottle 210 includes a first cooling element 212 and a second cooling element 214. Additionally, the bottle 210 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first orifice 28, a first bottle neck 30, a second orifice 34, a second bottle neck 36, a first liquid 11, a second liquid 13, and a dividing wall 21.

In FIG. 9 of the present disclosure, it is contemplated to use two cooling elements, a first cooling element 212 and a second cooling element 214 positioned at the base portion 18 of the bottle 210. The first cooling element 212 and the second cooling element 214 may be positioned in a separate compartment (single compartment or dual compartment) located at the bottom of the first chamber 14 and the second chamber 16, respectively, in order to cool liquid 11 with the first cooling element 212 and to cool liquid 13 with the second cooling element 214. In other words, each chamber 14, 16 may include its own separate cooling element for cooling each liquid. It is noted that the cooling elements 212, 214 may be removable cooling elements that can be replaced at any time by the user of the bottle 210. The cooling elements 212, 214 may be any type of cooling elements contemplated by one skilled in the art.

Figure 10:
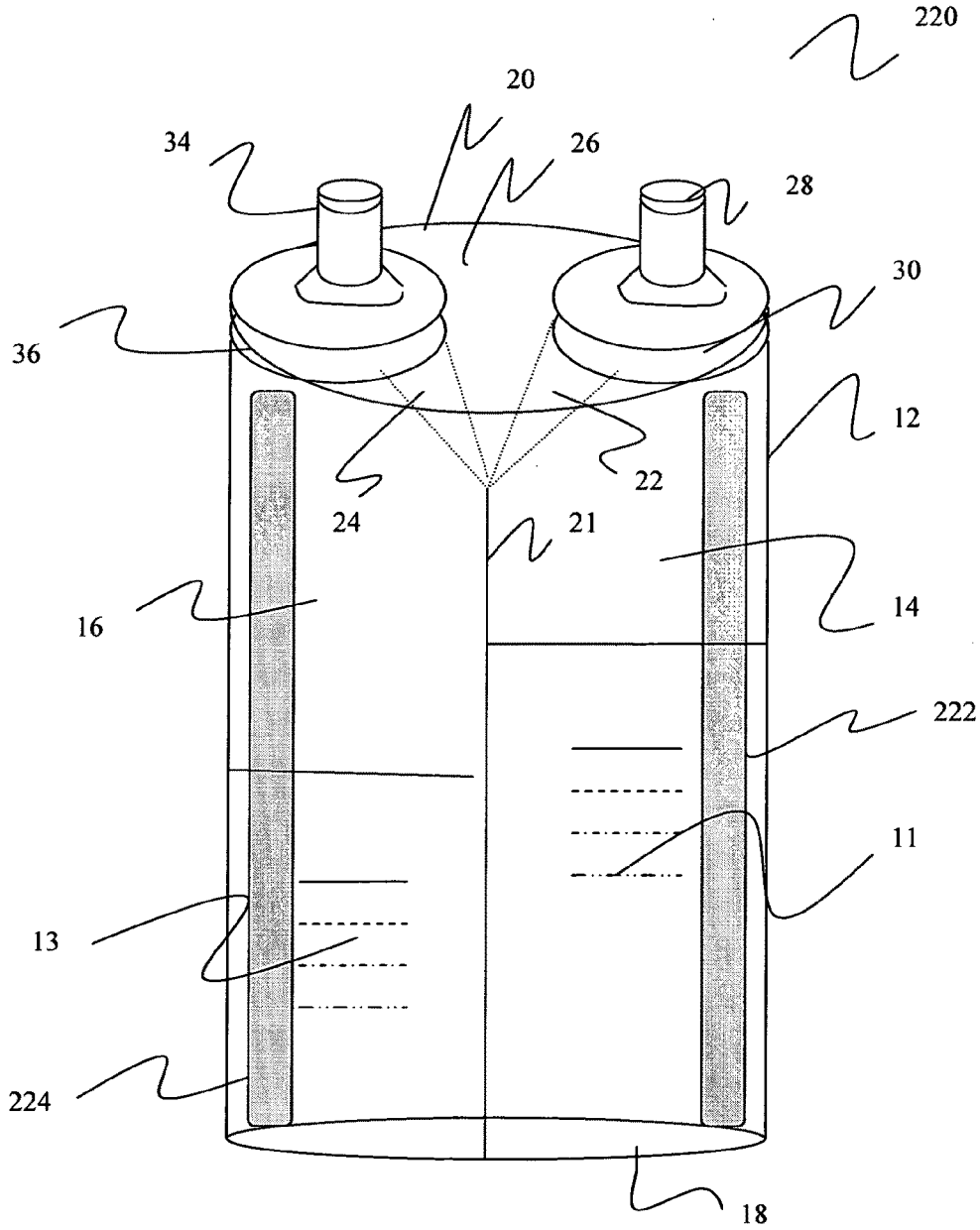
FIG. 10 is a perspective view of a dual-chambered drinking bottle having two volumetrically equal-sized chambers including two separate cooling elements located on a side portion of the bottle, in accordance with the present disclosure.

With reference to FIG. 10, there is presented a perspective view of a dual-chambered drinking bottle having two volumetrically equal-sized chambers including two separate cooling elements located on a side portion of the bottle, in accordance with the present disclosure. The bottle 220 includes a first cooling element 222 and a second cooling element 224. Additionally, the bottle 220 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first orifice 28, a first bottle neck 30, a second orifice 34, a second bottle neck 36, a first liquid 11, a second liquid 13, and a dividing wall 21.

In FIG. 10 of the present disclosure, it is contemplated to use two cooling elements, a first cooling element 222 and a second cooling element 224 positioned at the side portions of the bottle 220. The first cooling element 222 and the second cooling element 224 may be positioned in a separate compartment located within the first chamber 14 and the second chamber 16, respectively, in order to cool liquid 11 with the first cooling element 222 and to cool liquid 13 with the second cooling element 224. In other words, each chamber 14, 16 may include its own separate cooling element for cooling each liquid. It is noted that the cooling elements 222, 224 may be removable (e.g., attachable or stick-on) cooling elements that can be replaced at any time by the user of the bottle 220. The cooling elements 222, 224 may be any type of cooling elements contemplated by one skilled in the art.

Figure 11:
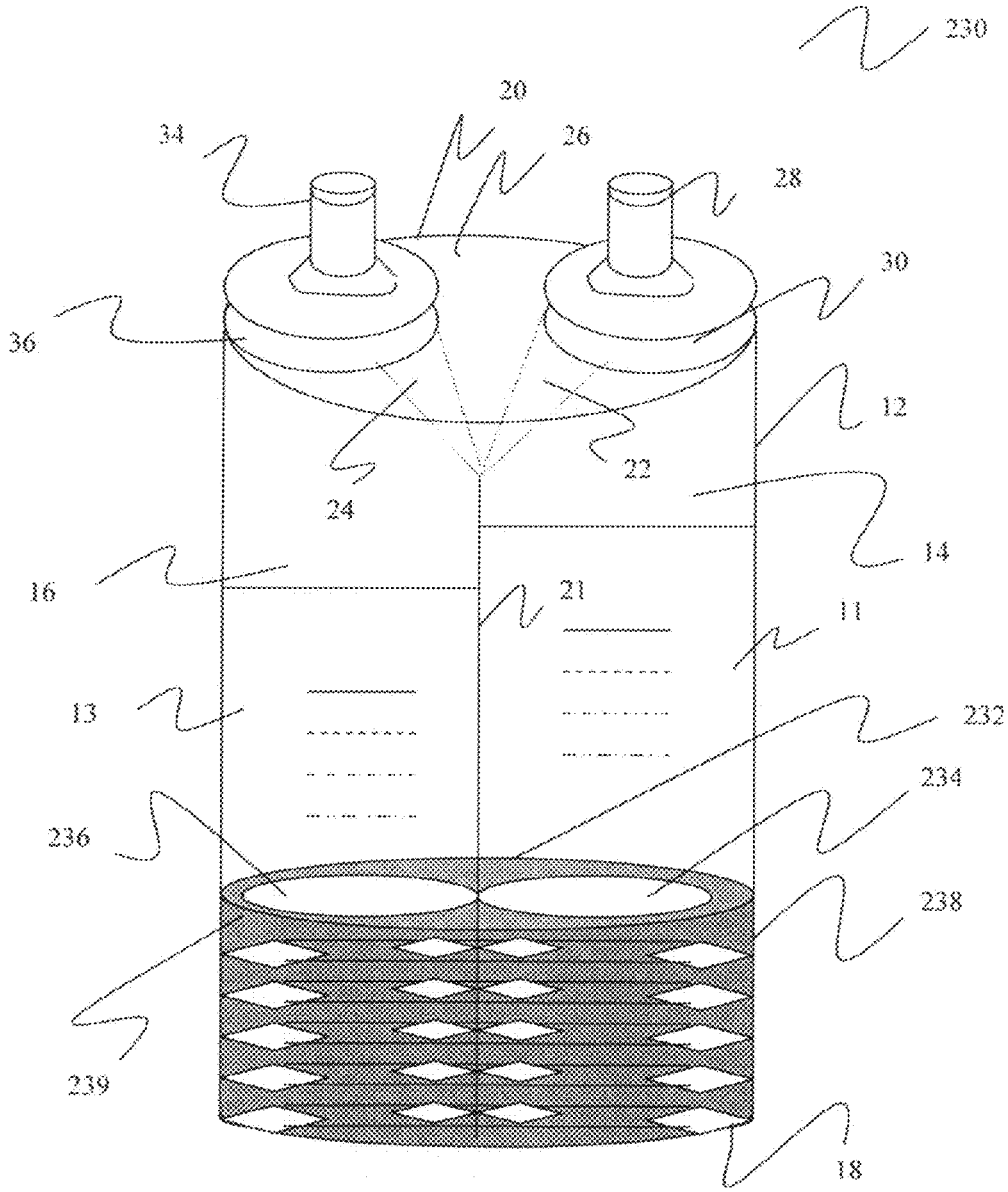
FIG. 11 is a perspective view of a dual-chambered drinking bottle having two volumetrically equal-sized chambers including a collapsible portion located on a bottom portion of the bottle, in accordance with the present disclosure.

With reference to FIG. 11, there is presented a perspective view of a dual-chambered drinking bottle having two volumetrically equal-sized chambers including a collapsible portion located on a bottom portion of the bottle, in accordance with the present disclosure. The dual chamber collapsible bottle 230 includes a top surface 232, a first chamber collapsible portion 234, a second chamber collapsible portion 236, a first liquid 238, and a second liquid 239 in the collapsible portions 234, 236, respectively. Additionally, the dual chamber collapsible bottle 230 includes similar elements to FIG. 1. These similar elements include a body or cylindrical enclosure 12, a first chamber 14, a second chamber 16, a base portion 18, a top portion 20, a first ridge 22, a second ridge 24, a gap portion 26, a first orifice 28, a first bottle neck 30, a second orifice 34, a second bottle neck 36, a first liquid 11, a second liquid 13, and a dividing wall 21.

In FIG. 11, it is contemplated that the bottle 230 can have a collapsible portion positioned at the base portion 18. The collapsible portion may be separated by a first chamber collapsible portion 234 and a second chamber collapsible portion 236. The first chamber collapsible portion 234 and the second chamber collapsible portion 236 may have a common top surface 232. The first chamber collapsible portion 234 may include a portion of the first liquid 238 and the second chamber collapsible portion 236 may include a portion of the second liquid 239. In other words, the portion of the first liquid 238 does not mix with the portion of the second liquid 239. The first liquid 11 is the same liquid as the first portion liquid 238, whereas the second liquid 13 is the same liquid as the second portion liquid 239. The first chamber 14 and the second chamber 16 remain separated by the dividing wall 21 that extends through the first chamber collapsible portion 234 and the second chamber collapsible portion 236.

When both, the first liquid 11 and the second liquid 13 fall below a predetermined threshold, the user of the bottle 230 may exert a force on the bottom surface of the base portion 18 and collapse/bend/shrink the bottle 230 up to the top surface 232. The top surface 232 may be designed to be positioned at any height of the bottle 230. Preferably, the height of the top surface 232 is positioned at or below the midpoint height of the bottle 230. The location of the top surface 232 may also depend on the length/height of the first chamber 14 and/or the length/height of the second chamber 16 and/or the height of the body 12. The first chamber collapsible portion 234 and the second chamber collapsible portion 236 are preferably substantially flush with the side walls of body 12.

In operation, when both the first liquid 11 and the second liquid 13 have been depleted or partially consumed by a user of the bottle 230, the user may exert as force and collapse/compress the base portion 18. The portion of the first liquid 238 channels into the first liquid 11 and the portion of the second liquid 239 channels into the second liquid 13. In other words, the liquids 238, 239 in each chamber 14, 16 move in a vertical, upward direction, as the user consumes the liquids in each chamber.

This embodiment is advantageous in shrinking the dimensions of the bottle 230 when it is desired to re-store the bottle 230. As described, the compression can occur when both the first liquid 11 and the second liquid 13 have been depleted from each chamber 14, 16, respectively. In other words, the present embodiment of the disclosure contemplates dual, simultaneous compression. However, one skilled in the art can contemplate a configuration that allows singular compression of only one liquid.

Figure 12:
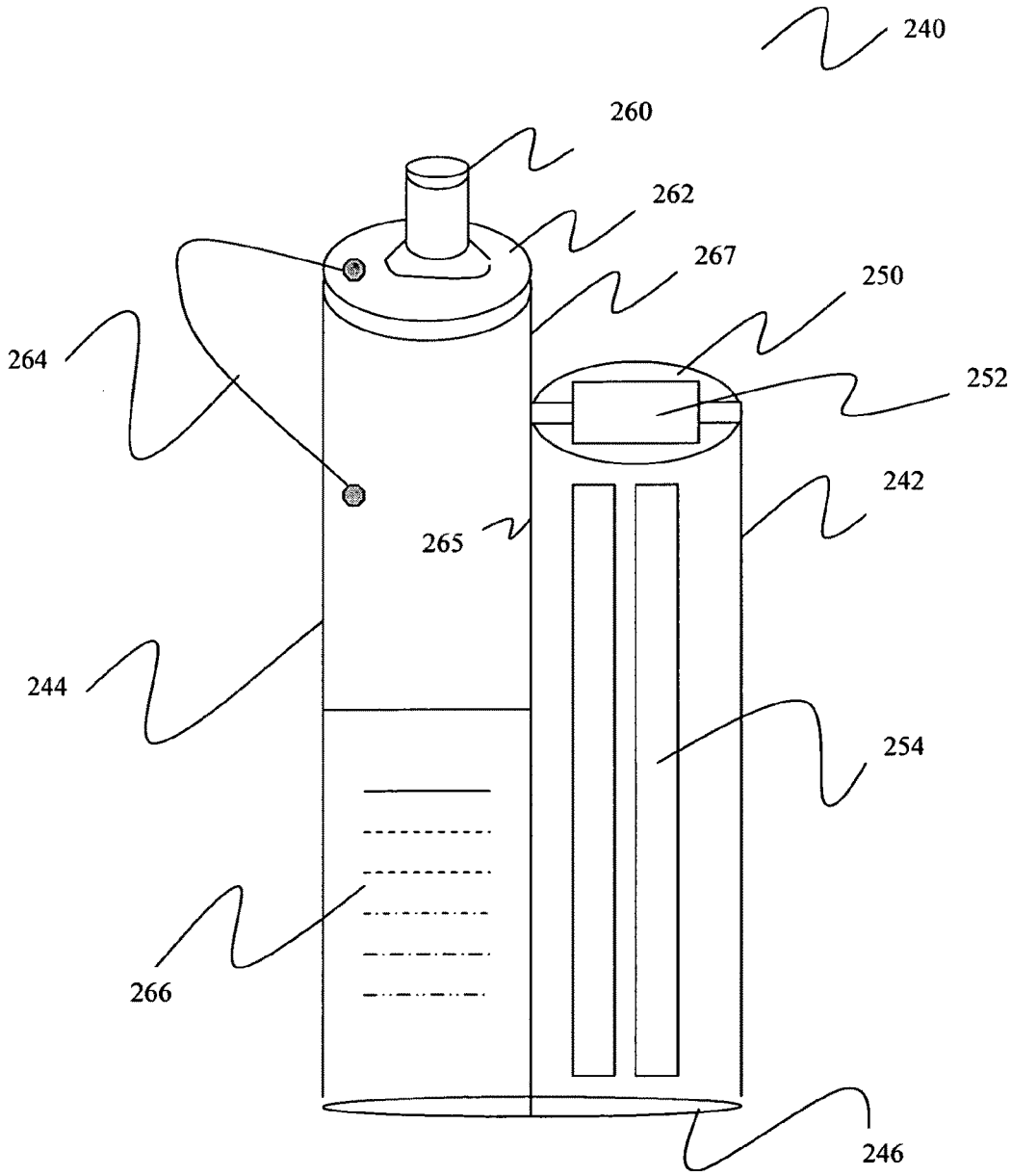
FIG. 12 is a perspective view of a dual-chambered drinking bottle having two volumetrically equal-sized chambers, one chamber enclosing liquids and one chamber enclosing non-liquids, in accordance with a third embodiment of the present disclosure.

With reference to FIG. 12, there is presented a perspective view of a dual-chambered drinking bottle having two volumetrically equal-sized chambers, one chamber enclosing liquids and one chamber enclosing non-liquids, in accordance with a third embodiment of the present disclosure. The bottle 240 includes a first chamber 242, a second chamber 244, a base portion 246, a top portion 250, an opening 252, a storage compartment 254, an orifice 260, a bottle neck 262, a lid strap 264, and a liquid 266. The bottle 240 further includes a dividing wall 265 and an upper wall 267.

Dual chamber bottle 240 includes a body that is preferably formed of a hollow molded plastic material that defines two substantially cylindrical chambers 242, 244 and has a base portion 246. The bottle 240 includes a first chamber 242 for holding non-liquids in a storage compartment 254, and a second chamber 244 for holding a liquid 266. The second chamber 244 is connected to an orifice 260 via a bottle neck 262. Optionally, the orifice 260 may be connected to the second chamber 244 via a lid strap 264. The orifice 260 may be replaced by any type channel providing an outlet means to the mouth of a user.

The dividing wall 265 extends vertically from the base portion 246, extending through the body and ending at a height, equal to the height of the shortest chamber. The dividing wall 265 provides a means for separating the first chamber 242 from the second chamber 244. The dividing wall 265 allows the user to access the first chamber 242 having an opening 252 on the top portion 250 in order to place or remove items in the storage compartment 254.

Any types of items may be placed in the storage compartment 254. For example, a user may place one or more energy bars and/or one or more energy gels in the storage compartment 254. In addition, the storage compartment 254 may be used to store keys or other personal items that the user does not wish to handle while exercising. As a result of this embodiment, a user may be able to carry both liquid and non-liquid items, without the fear of having the liquid and non-liquid items mix together.

The upper wall 267 provides for a height differential between the first chamber 242 and the second chamber 244. The height differential can vary from a few millimeters to a few inches depending on the application or aesthetics. The height of the dividing wall 265 is less than the overall height of the body. Also, the connecting point of the first chamber 242 and the second chamber 244 is configured to be a maximum height of the dividing wall 265.

Moreover, while threaded connections are utilized to connect various components in the described embodiments, many other forms of connections, such as snap together connections, twist-to-lock connections and the like also can be utilized. The present disclosure may also include a twist-on or snap-on spout or nozzle, preferably of a tapered conical or substantially cylindrical shape, and internally divided. The spout or nozzle may be adapted to be sealed by an end cap, a plug, by helically twisting the "overcap" upon a "scaling rod", or by sliding upon an internal shaft affecting a seal when screwed or pushed downwards towards the bottle.

Optionally, the body of all bottles of the present disclosure may be constructed of a clear or transparent or translucent material in order to better identify the liquid contained within the first chamber and the second chamber.

Additionally, all the bottles of the present disclosure are not limited to any particular bottle shape or design. Although the bottles are described and depicted herein as being of generally cylindrical upstanding form, the configurations of the containers is a matter of design choice. The use of generally cylindrical containers is described because it gives the sports bottle a readily acceptable appearance and shape, and because generally cylindrical container shapes tend to work well if one also desires to make use of generally cylindrical, externally threaded container necks. Moreover, generally cylindrical containers tend to efficiently provide good fluid-carrying capacity at relatively low manufacturing cost. While opaque, single-thickness materials may be preferred for use, transparent or plural-layer materials may be used, if desired, to enhance visibility, to provide added insulating capability, or for other purposes.

Moreover, the first chamber and the second chamber of all the bottles of the present disclosure may be designed to contain different ratios of liquids. For example, a 50/50 ratio between the first chamber and the second chamber may be preferred (as described in FIG. 1). However, it is envisioned that even a 1/3 to 2/3 ratio may be practical for certain applications (as described in FIG. 2).

Furthermore, all the bottles of the present disclosure may include one or more caps or lids, and each of the one or more caps or lids may have a strap connected to the body. All the bottles of the present disclosure may include one or more cooling elements to cool the liquids contained within the chambers or containers. All the bottles of the present disclosure may include one or more collapsible portions to bend the chamber or containers. All the bottles of the present disclosure may be of different widths and/or heights, and each chamber of all the bottles may be of a different width and/or height. All the bottles of the present disclosure may have different caps of different shapes and/or sizes with a plurality of fastening means. All the bottles of the present disclosure may include slidable orifices moving on a slidable track in a variety of tracks. All the bottles of the present disclosure may have interchangeable parts.

Finally, all the bottles of the present disclosure may be constructed by any manufacturing means. For example, blow molding technology may be utilized. A plurality of different types of thermoplastic resins may be utilized in any type of blow molding techniques.

Accordingly, the present disclosure prevents the mixing of contents of multiple chambers during the dispensing process, thus minimizing or even eliminating the risk that two liquids are simultaneously dispensed in an inadvertent manner.

It will be understood that there are to be no limitations as to the dimensions and shape of the beverage bottle, including the storage compartment, or the materials from which the beverage bottle is manufactured. The bottles may be constructed to resemble any commercially available bottle for holding a liquid beverage and may be manufactured from any suitable plastic, glass or metal material. Furthermore, it should be understood that the beverage bottle of the present disclosure may be adapted to store any suitable liquid, such as, for example, water, juice, milk, carbonated sodas, protein shakes, energy drinks, beer, wine, and liquor.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the invention above, various modifications of the techniques, procedures, material and equipment will be apparent to those in the art. It is intended that all such variations within the scope and spirit of the appended claims be embraced thereby.

The foregoing examples illustrate various aspects of the invention and practice of the methods of the invention. The examples are not intended to provide an exhaustive description of the many different embodiments of the invention. Thus, although the foregoing invention has been described in some detail by way of illustration and example for purposes of clarity and understanding, those of ordinary skill in the art will realize readily that many changes and modifications can be made thereto without departing form the spirit or scope of the invention.

What is claimed is:

1. A bottle, comprising:

a body portion having a dividing wall extending from a base portion to a connection region;

a first chamber for holding a first liquid, the first chamber cooperating with a first orifice; and a second chamber for holding a second liquid, the second chamber cooperating with a second orifice;

wherein a height of the dividing wall is less than an overall height of the body portion and the connection region is configured to be a maximum height of the dividing wall;

wherein the first chamber defines a first longitudinal axis extending through the first orifice and the second chamber defines a second longitudinal axis extending through the second orifice, such that the first and second longitudinal axes are parallel to each other as they extend from the base portion of the bottle to the first and second orifices; and wherein a single outer rim circumferentially extends around the body portion of the bottle and both orifices where top portions of the first and second chambers, respectively, connect thereto.

2. The bottle according to claim 1, wherein the first chamber is a same volumetric size as the second chamber.

3. The bottle according to claim 1, wherein the first chamber and the second chamber are a same height.

4. The bottle according to claim 1, wherein the first orifice is positioned on a first bottle neck and the second orifice is positioned on a second bottle neck.

5. The bottle according to claim 4, wherein the first bottle neck engaging the first orifice is separated from the second bottle neck engaging the second orifice.

6. A method for manufacturing a bottle, the method comprising the steps of:

forming a body portion having a dividing wall extending from a base portion to a connection region;

forming a first chamber for holding a first liquid, the first chamber cooperating with a first orifice; and forming a second chamber for holding a second liquid, the second chamber cooperating with a second orifice;

wherein a height of the dividing wall is less than an overall height of the body portion and the connection region is configured to be a maximum height of the dividing wall;

wherein the first chamber defines a first longitudinal axis extending through the first orifice and the second chamber defines a second longitudinal axis extending through the second orifice, such that the first and second longitudinal axes are parallel to each other as they extend from the base portion of the bottle to the first and second orifices; and wherein a single outer rim circumferentially extends around the body portion of the bottle and both orifices where top portions of the first and second chambers, respectively, connect thereto.

7. A bottle, comprising:

a body portion having a dividing wall extending from a base portion to a connection region;

a first chamber for holding a first liquid, the first chamber cooperating with a first orifice; and a second chamber for holding a second liquid, the second chamber cooperating with a second orifice;

wherein a height of the dividing wall is less than an overall height of the body portion and the connection region is configured to be a maximum height of the dividing wall;

wherein the first and second orifices diverge from a top portion of the body portion of the bottle in a non-angular manner with respect to each other; and wherein a single outer rim circumferentially extends around the body portion of the bottle and both orifices where top portions of the first and second chambers, respectively, connect thereto.

8. A bottle, comprising:

a body portion having a dividing wall extending continuously from a base portion to a connection region;

a first chamber cooperating with a first orifice; and a second chamber cooperating with a second orifice;

wherein the first and second orifices diverge from a top portion of the body portion of the bottle in a non-angular manner with respect to each other; and wherein a single outer rim circumferentially extends around the body portion of the bottle and both orifices where top portions of the first and second chambers, respectively, connect thereto.

9. The method according to claim 6, wherein the first chamber is a same volumetric size as the second chamber.

10. The method according to claim 6, wherein the first chamber and the second chamber are a same height.

11. The method according to claim 6, wherein the first orifice is positioned on a first bottle neck and the second orifice is positioned on a second bottle neck.

12. The method according to claim 11, wherein the first bottle neck engaging the first orifice is separated from the second bottle neck engaging the second orifice.

13. The bottle according to claim 7, wherein the first chamber is a same volumetric size as the second chamber.

14. The bottle according to claim 7, wherein the first chamber and the second chamber are a same height.

15. The bottle according to claim 7, wherein the first orifice is positioned on a first bottle neck and the second orifice is positioned on a second bottle neck.

16. The bottle according to claim 15, wherein the first bottle neck engaging the first orifice is separated from the second bottle neck engaging the second orifice.

17. The bottle according to claim 8, wherein the first chamber is a same volumetric size as the second chamber.

18. The bottle according to claim 8, wherein the first chamber and the second chamber are a same height.

19. The bottle according to claim 8, wherein the first orifice is positioned on a first bottle neck and the second orifice is positioned on a second bottle neck.

20. The bottle according to claim 19, wherein the first bottle neck engaging the first orifice is separated from the second bottle neck engaging the second orifice.

* * * * *